US011033448B1

(12) United States Patent
Elkossei

(10) Patent No.: US 11,033,448 B1
(45) Date of Patent: Jun. 15, 2021

(54) MEDICAL BED APPARATUS

(71) Applicant: Ashraf Elkossei, Oak Lawn, IL (US)

(72) Inventor: Ashraf Elkossei, Oak Lawn, IL (US)

( * ) Notice: Subject to any disclaimer, the term of this patent is extended or adjusted under 35 U.S.C. 154(b) by 136 days.

(21) Appl. No.: 16/106,275

(22) Filed: Aug. 21, 2018

(51) Int. Cl.
*A61G 7/10* (2006.01)

(52) U.S. Cl.
CPC ..... *A61G 7/1044* (2013.01); *A61G 7/1015* (2013.01); *A61G 7/1019* (2013.01)

(58) Field of Classification Search
CPC ... A61G 7/1019; A61G 7/1044; A61G 7/1015
See application file for complete search history.

(56) References Cited

U.S. PATENT DOCUMENTS 1,977,944 A * 10/1934 Haskett ..... A61G 7/1015 5/84.1
3,877,089 A * 4/1975 Spivey ..... A61G 7/1011 5/85.1
4,397,051 A * 8/1983 Wheeler ..... A61G 7/1015 5/84.1
4,704,750 A * 11/1987 Wheelock ..... A45F 3/22 5/120
5,072,840 A 12/1991 Asakawa
8,973,898 B2 * 3/2015 Hurd ..... B66F 3/02 254/2 R
2005/0044269 A1 2/2005 Abdelkrim

* cited by examiner

*Primary Examiner* — David R Hare
*Assistant Examiner* — Adam C Ortiz
(74) *Attorney, Agent, or Firm* — Sanchelima & Associates, P.A.; Christian Sanchelima; Alexander Rodriguez

(57) ABSTRACT

The present invention is directed towards an apparatus for holding a patient in a suspended manner on top of a bed for facilitating bed maintenance. The apparatus comprises at least one support member provided in the proximity of the bed. A hammock is disposed on the bed and is mechanically coupled to the at least one support member for being lifted and lowered by the at least one support member. The support members have a telescopic reciprocating configuration. In one embodiment, the support members include fluid operated cylinders, e.g., hydraulic and pneumatic cylinders. In another embodiment, the support member is a mechanically operating support member. The mechanically operating support member includes either a rack and pinion arrangement or a lead screw arrangement.

15 Claims, 6 Drawing Sheets

MEDICAL BED APPARATUS

BACKGROUND OF THE INVENTION

1. Field of the Invention

The present disclosure relates to medical beds. In particular, the present disclosure relates to an apparatus to be used in conjunction with a medical bed for easing the process of maintenance of the beds holding immobilized patients.

2. Description of the Related Art

The maintenance of a bed holding an immobilized patient is generally a difficult task. It requires the immobilized patient to be moved to a different bed, and doing so may get extremely difficult as the immobilized patient has to be carefully carried to the different bed using a stretcher and nurses. Hence, there is need of an apparatus that can ease the process of maintenance of beds that are accommodating bed-ridden or immobilized patients.

Several designs for medical beds or patient movement setups have been designed in the past. None of them, however, are known to have a compact configuration while being able to hold the patient comfortably when the bed maintenance is being performed.

Applicant believes that a related reference corresponds to U.S. Patent Publication No. 20050044629 filed by SAMUEL ROUSE AND AMANDIA ROUSE. The Rouse reference discloses a patient movement system that comprises a rotatable section coupled to a frame that moves in a horizontal plane and having a hoist assembly coupled to the rotatable section for spinning relative to the rotatable section. However, the system disclosed in the Rouse reference has a large number of components and a bulky configuration.

Another related application is U.S. Pat. No. 5,072,840 filed by YOSHIO ASAKAWA AND YASUNAGA SUEZAKI. The Yoshio reference discloses a medical bed apparatus that has a body frame, a hoisting assembly and a hammock supported from the hoisting assembly by hanging strings. However, the apparatus disclosed in the Yoshio reference has a large number of components and a bulky configuration.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide a medical bed apparatus that eases the process of maintenance of the beds holding immobilized patients.

It is yet another object of the present invention to provide a medical bed apparatus that has a compact configuration.

It is yet another object of the present invention to provide a medical bed apparatus that has a simple operation.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
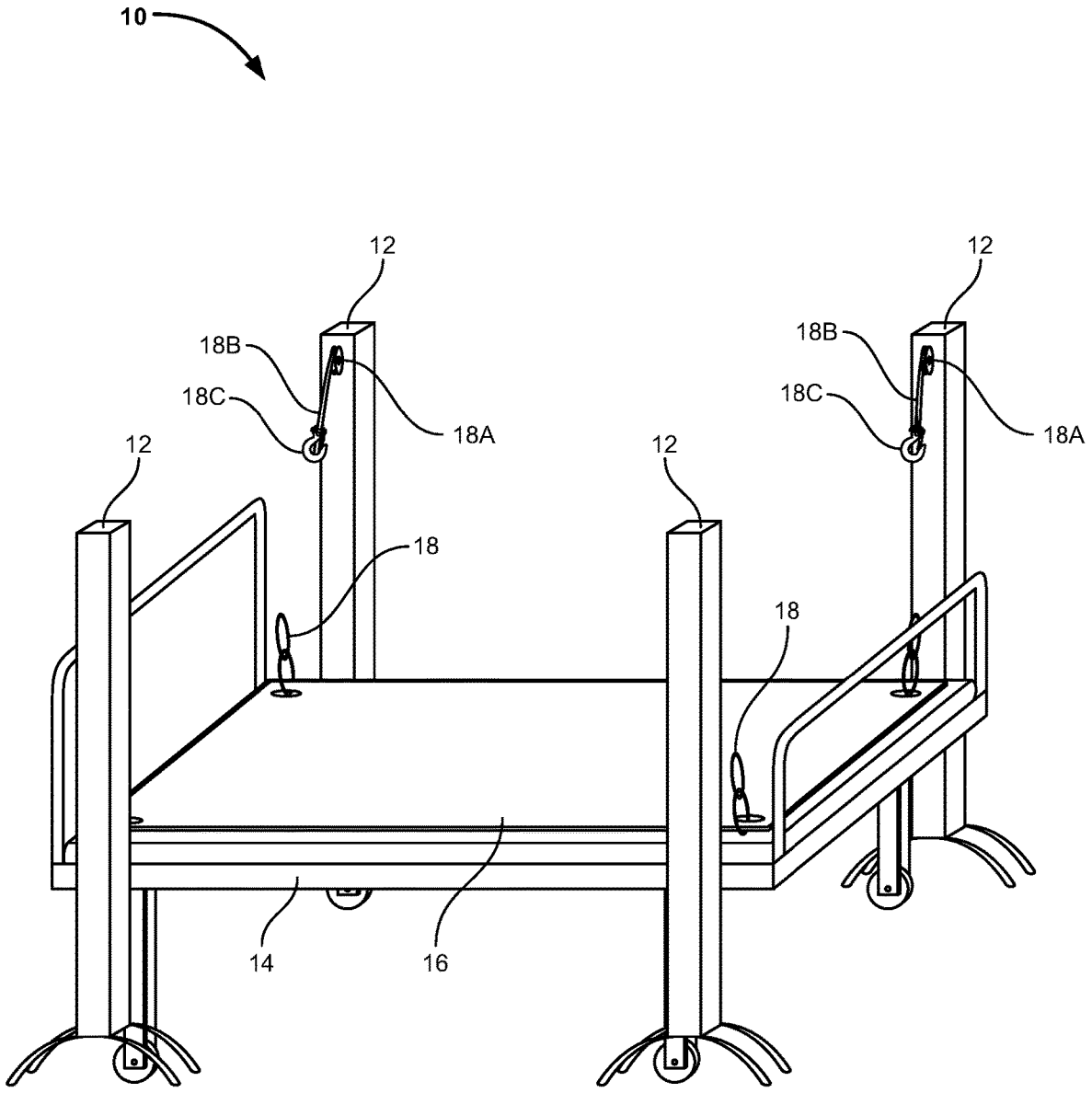
FIG. 1 represents an isometric view of a medical bed apparatus 10, which comprises a plurality of support members 12 disposed around a bed 14 and a hammock 16 disposed on the bed 14.

Referring now to the drawings, FIGS. 1-6, where the present invention is generally referred to with numeral 10, it can be observed that a medical bed apparatus 10, in accordance with the present invention, comprises a plurality of support members 12 disposed around a bed 14. The support members 12 are used to lift a hammock 16 with a patient supported thereon for facilitating easy maintenance of the patient's bed.

The apparatus 10 for holding a patient in a suspended manner on top of a bed 14 for facilitating bed maintenance comprises at least one support member 12 provided in the proximity of the bed. A hammock 16 disposed on the bed and is coupled to the at least one support member 12 for being lifted and lowered by the at least one support member 12.

More specifically, the support members 12 have a telescopic reciprocating configuration. The telescopic reciprocating configuration refers to the operation of the support members 12 in which the support members 12 are configured to be extended or retracted per the application requirements. In the present invention, the support members 12 are configured to be extended and retracted in an operative vertical direction.

Figure 2:
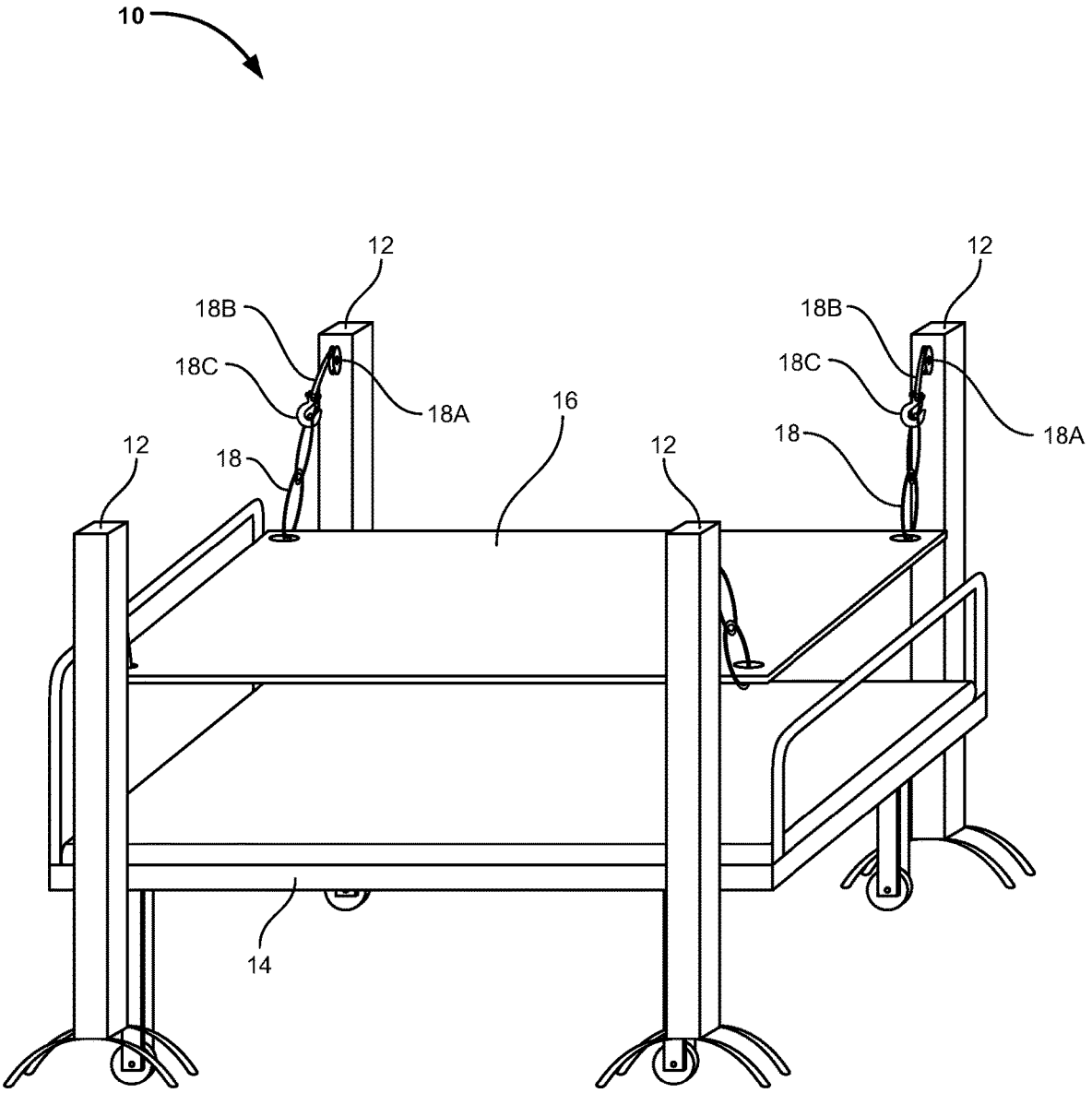
FIG. 2 demonstrates another isometric view of a medical bed apparatus 10, wherein the hammock 16 is raised by the plurality of support members 16.

The purpose of the operative vertical extension and retraction is to vary the functional height of the hammock 16 with respect to the bed 14. More specifically, the apparatus 10 further comprises at least one securing means 18, wherein one end of the at least one securing means 18 is connected to the hammock 16 on at least one location, while the other end of the securing means 18 is connected to an operative top portion of the at least one support member 12. In an embodiment, the securing means 18 is a looped cable or a set of interlinked looped cables. The apparatus 10 further comprises a pulley 18A disposed at the operative top end of the support member 12 to allow a cable 18B to roll thereon. The cable 18B includes a hook 18C at an operative end thereof. More specifically, the hook 18C connects with the securing means 18. The telescopic extension and retraction of the support member 12 causes the hammock 16 to be lifted or lowered, as is seen in FIG. 1 and FIG. 2. While the hammock 16 is lifted, the patient that is supported on the hammock 16 is held in a suspended manner by the hammock 16. This allows easy maintenance or replacement of the bed that the immobilized patient is occupying.

In one embodiment, the apparatus 10 comprises four support members 12, wherein each support member 12 is placed at each corner of the bed or the hammock, as is seen in FIG. 1 and FIG. 2. In another embodiment, the four support members 12 are disposed at locations proximal the mid-point of each side of the hammock 16 for holding the immobilized patient on the hammock 16 in a stable suspended manner.

Figure 3:
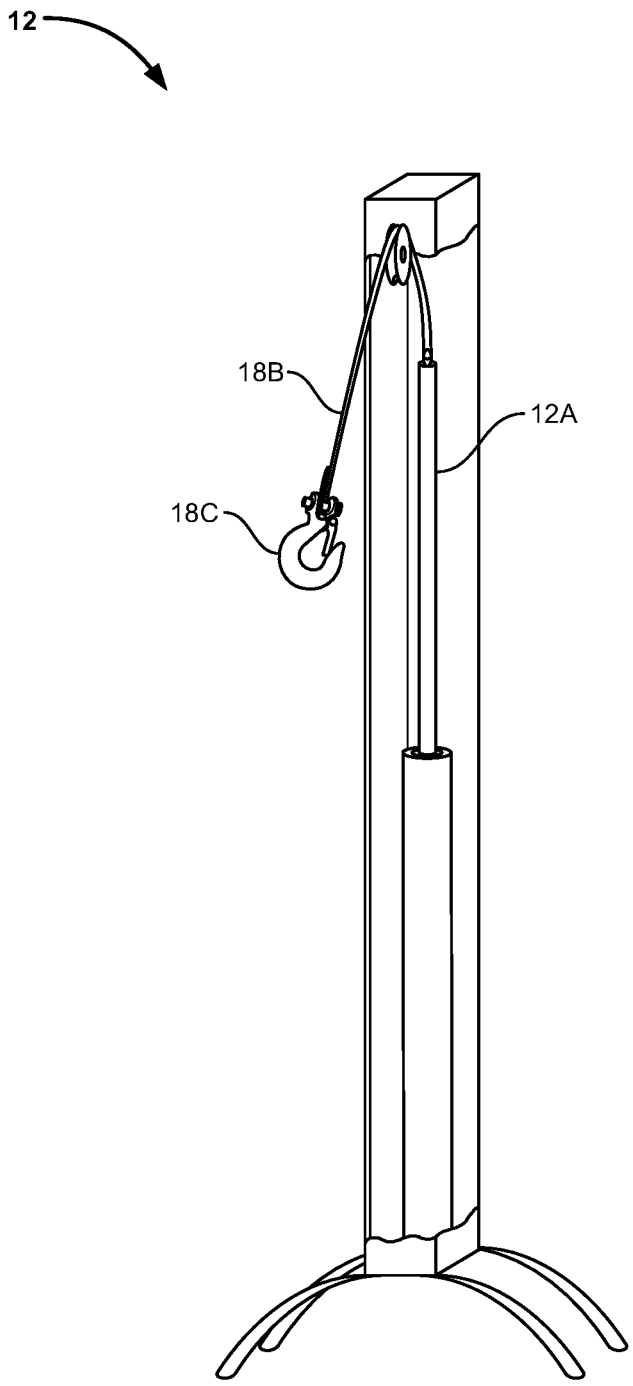
FIG. 3 demonstrates a view of the support member 12 used in the medical bed apparatus 10, wherein the support member 12 is a fluid operated supported member.

In accordance with one embodiment, wherein the support member 12 with the telescopic reciprocating configuration is a fluid operated supported member. More specifically, support member 12 includes either a hydraulic cylinder or a pneumatic cylinder. FIG. 3 illustrates the embodiment of the support member 12 having the fluid operated cylinder 12A, which can either be a hydraulic cylinder or a pneumatic cylinder. The apparatus 10 further comprises an actuator for actuating all the four support members 12 in conjunction.

Figure 4:
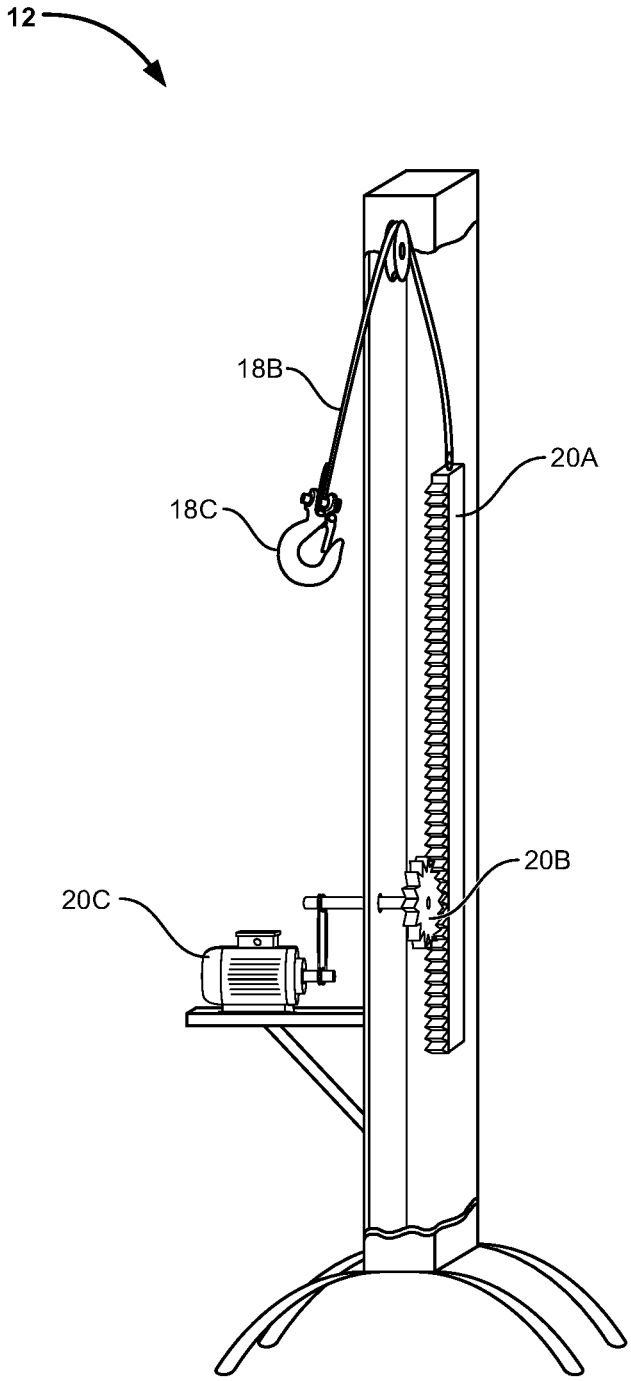
FIG. 4 demonstrates a view of the support member 12 used in the medical bed apparatus 10, wherein the support member 12 includes a rack and pinion arrangement 20A, 20B.
Figure 5:
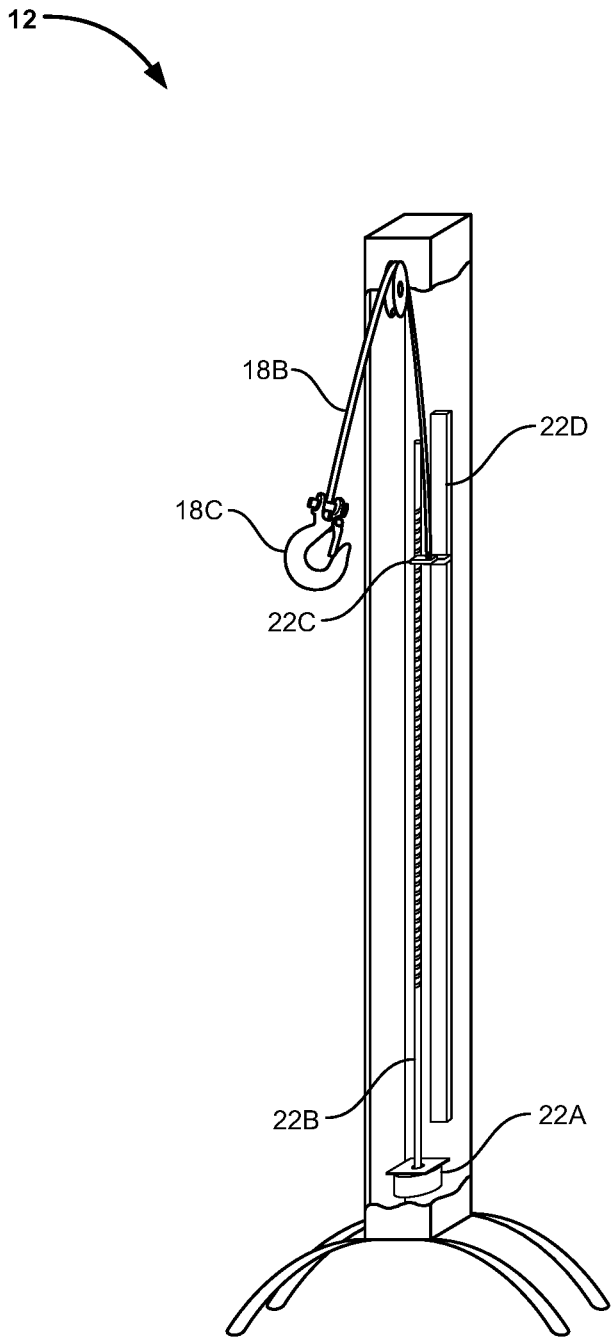
FIG. 5 demonstrates a view of the support member 12 used in the medical bed apparatus 10, wherein the support member 12 includes a lead screw arrangement 22A, 22B.
Figure 6:
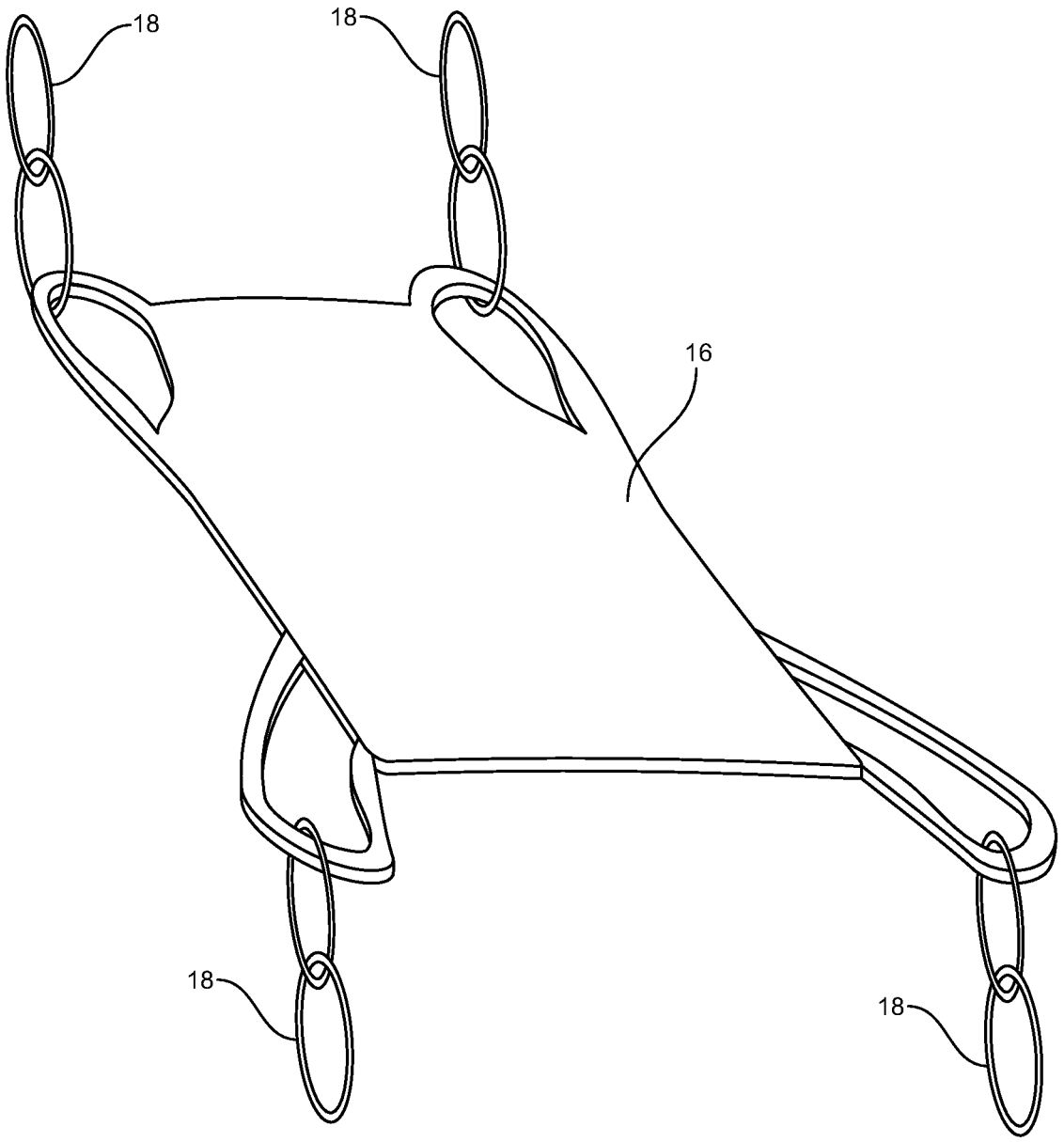
FIG. 6 demonstrates an isometric view of the hammock 16 used in the medical bed apparatus 10, having the securing means 18.

In another embodiment, the support member 12 with the telescopic reciprocating configuration is a mechanically operating support member. Referring to FIG. 4, the support member 12 comprises a rack and pinion arrangement 20A, 20B. The support member 12 further comprises a motor 20C for driving the pinion gear 20B. In the present embodiment, the apparatus 10 can further include a controller (not shown in figures) for operating the motors 20C in tandem.

The operative configuration of the aforementioned embodiment is hereinafter described. In the inoperational state of the apparatus 10, the hammock 16 is disposed on the bed 14, while being connected to the support members 12 via securing means 18 and the hooks 18C. When there is felt a need to perform maintenance of the bed on which the immobilized patient is being held, the controller (not shown in figures) is activated and all the four motors 20C of all the four support members are actuated. The actuation of the motors 20C causes the rotation of the pinion gear 20B, which causes the extension of the support members 12 by causing the rack 20A to be extended, thereby increasing the functional height of the hammock 16 until the hammock 16 holds the immobilized patient thereon in a suspended manner.

In yet another embodiment, the mechanically operating support member 12 comprises a lead screw arrangement 22. The lead screw arrangement 22 comprises a motor 22A provided at the operative bottom end of the support member 12. The motor 22A is coupled to a lead screw 22B for driving the lead screw 22B. The term driving herein refers to causing the rotation of the lead screw 22B. On the lead screw 22B is supported a bracket 22C. The rotation of the lead screw 22B, which is facilitated by the motor 22A, causes the translation of the bracket 22C on the lead screw 22B, which is supported by a rail 22D, thereby causing the extension or retraction of the support member 12.

In accordance with a manual implementation of the present invention, the actuation of a push button (not illustrated in figures) will push the sheet and bed to the top of the support members 12, as high as it can go. Once the support members 12 are extended to their maximum height, the sheet could be hooked manually to the support members 12. Subsequent to hooking of the sheet, the push button is actuated again to lower the bed down, leaving the sheet still hung on the support members 12. The caregiver then changes the bed sheets and makes the bed ready for the patient. Once the caregiver is finished, the push button is actuated to lift the bed to the sheet and the sheet is unhooked, and the push button is pressed again to lower the sheet and bed together.

In accordance with an automatic implementation of the present invention, the actuation of a push button will push the sheet and bed to the top of the support members 12, as high as it can go. Once the support members 12 are extended to their maximum height, the sheet could be hooked manually to the support members 12. Subsequent to hooking of the sheet, the push button is actuated again to lower the bed down, leaving the sheet still hung on the support members 12. The caregiver then changes the bed sheets and makes the bed ready for the patient. Once the caregiver is finished, they release the air pressure from the support members 12, letting the sheet to go down automatically towards the bed.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An apparatus for holding a patient in a suspended manner on top of a bed for facilitating bed maintenance, the apparatus comprising:
   a. at least one support member provided in the proximity of the bed, said at least one support member includes a rack and a pinion within;
   b. a hammock disposed on the bed, said hammock including a plurality of apertures, each of said apertures located at a corner of said hammock, at least one securing member secured to each of said plurality of apertures, the hammock being coupled to the at least one support member via the at least one securing member for being lifted and lowered by the at least one support member, at least one cable to secure said at least one support member and said hammock together, wherein one end of the at least one cable is connected to the at least one securing member, while an opposite end of the cable is connected to a top portion of the rack.

2. The apparatus as claimed in claim 1, wherein the at least one support member has a telescopic reciprocating configuration.

3. The apparatus as claimed in claim 2, wherein the support member with the telescopic reciprocating configuration is a mechanically operating support member.

4. The apparatus as claimed in claim 1, said rack and said pinion engage one another and are in constant abutting contact with one another.

5. The apparatus as claimed in claim 1, further including a motor for actuating the pinion to travel along said rack.

6. The apparatus as claimed in claim 1, further comprising a pulley provided at an operative top end of the support member far facilitating the rolling of the cable thereon.

7. The apparatus as claimed in claim 1, wherein the apparatus includes four support members, wherein each of the support member is placed at each corner of the bed.

8. The apparatus as claimed in claim 1, wherein said at least one securing member is in a ring configuration.

9. The apparatus as claimed in claim 1, wherein said at least one securing member is in an interlinked ring configuration.

10. The apparatus as claimed in claim 1, wherein said rack extends a partial height of each of said at least one support member.

11. The apparatus as claimed in claim 5, wherein said pinon includes a rod extending therefrom, said rod extending outwardly and partially from each of said at least one support member.

12. The apparatus as claimed in claim 11, wherein said motor and said rod are interconnected together with a rope member extending in between to actuate said pinion with said motor for movement along said rack.

13. The apparatus as claimed in claim 1, wherein said rack includes rack teeth that extend outwardly and away from said rack, said pinion including pinion teeth, said rack teeth engage and cooperate with said pinion teeth to movement of said pinion along said rack.

14. The apparatus as claimed in claim 1, wherein at a distal end of said at least one cable includes a hook, said hook engaging said at least one securing member to selectively elevate said hammock.

15. The apparatus as claimed in claim 1, wherein each of said at least one support member includes feet, said feet extending and curving downwardly and away from said at least one support member.

* * * * *